US007040423B2

(12) United States Patent
Larsen et al.

(10) Patent No.: US 7,040,423 B2
(45) Date of Patent: May 9, 2006

(54) NOZZLE BORE FOR HIGH FLOW RATES

(75) Inventors: James L. Larsen, Spring, TX (US); Dwayne P. Terracina, Spring, TX (US); Jeffrey D. Leisey, Houston, TX (US)

(73) Assignee: Smith International, Inc., Houston, TX (US)

( * ) Notice: Subject to any disclaimer, the term of this patent is extended or adjusted under 35 U.S.C. 154(b) by 262 days.

(21) Appl. No.: 10/788,258

(22) Filed: Feb. 26, 2004

(65) Prior Publication Data

US 2005/0189148 A1 Sep. 1, 2005

(51) Int. Cl.
*E21B 10/18* (2006.01)

(52) U.S. Cl. ..... 175/339; 175/340; 175/424

(58) Field of Classification Search ..... 175/339, 175/340, 424, 393
See application file for complete search history.

(56) References Cited

U.S. PATENT DOCUMENTS 4,759,415 A * 7/1988 Pessier ..... 175/340
5,494,122 A 2/1996 Larsen et al. ..... 175/340
5,538,093 A 7/1996 Siracki et al. ..... 175/393
5,669,459 A 9/1997 Larsen et al. ..... 175/340
6,079,507 A * 6/2000 Trujillo et al. ..... 175/57
6,142,248 A * 11/2000 Thigpen et al. ..... 175/340
RE37,006 E 1/2001 Siracki et al. ..... 175/393
6,290,006 B1 9/2001 Crawford ..... 175/339
6,311,793 B1 * 11/2001 Larsen et al. ..... 175/340
6,571,887 B1 6/2003 Nguyen et al. ..... 175/57
6,585,063 B1 7/2003 Larsen ..... 175/57

FOREIGN PATENT DOCUMENTS

EP 0 669 449 A2 6/1996
EP 0 669 449 A3 6/1996

OTHER PUBLICATIONS

United Kingdom Combined Search and Examination Report for Appl. No. GB0504101.7; dated May 6, 2005; 6 pages.

* cited by examiner

*Primary Examiner*—Frank S Tsay
(74) *Attorney, Agent, or Firm*—Osha Liang LLP

(57) ABSTRACT

The present invention relates to a roller cone drill bit that has improved flow characteristics. The roller cone drill bit includes forming at least one relief region inside a bit body of the roller cone drill bit on a ledge formed between a fluid plenum and at least one of the fluid orifices. A method of locating the at least one relief region is also disclosed.

58 Claims, 12 Drawing Sheets

NOZZLE BORE FOR HIGH FLOW RATES

BACKGROUND ART

FIG. 1 shows a typical rotary drilling rig. A drill bit 10 is connected to the end of a drill string 12. Drilling fluid, typically referred to as mud, is pumped through the drill string into the drill bit by surface equipment 11. The mud performs a variety of functions. For example, the mud cools the drill bit, cleans the cutting structures, helps penetrate the formation, and carries the cuttings to the surface. To accomplish these tasks, a high flow rate of mud must be maintained while drilling. The desired flow rate is often as high as possible based on the surface equipment 11, pressure losses in the drill string, and the capabilities of the equipment in the drill string to handle the flow.

Drill bits used to drill wellbores through earth formations generally fall within one of two broad categories of bit structures. Drill bits in the first category are known as "fixed cutter" or "drag" bits. Bits of this type usually include a bit body formed from steel or another high strength material and a plurality of cutting elements disposed at selected positions about the bit body. Drill bits of the second category are typically referred to as "roller cone" bits. An example of a prior art roller cone bit is shown in FIG. 2. The roller cone bit includes a bit body 215 having at least one roller cone 214 rotatably mounted thereto. The roller cone bit body 215 is commonly made from a plurality of legs, in this example three, that are welded together.

FIG. 3 illustrates a cross-section of one leg 301 of a prior art roller cone bit. The joining of the legs forms a fluid inlet 308 and an internal plenum 304. At least one fluid orifice 307 is typically machined in leg 301. The fluid orifice 307 comprises an entrance 302, a nozzle seat 306, an O-ring gland 310, and a receptacle 311 designed for the attachment of a nozzle 313. During drilling, fluid, not shown, enters the bit body 215 at the fluid inlet 308 and continues into the fluid plenum 304. The fluid is forced against a bottom of the fluid plenum 305 until it reaches the fluid orifice 307 where it exits the bit body 215 through the nozzle 313.

Generally, the fluid velocity within the fluid plenum 304 is relatively low. However, as the fluid moves into the fluid orifice 307, it accelerates due to the reduction of flow area. Significantly, the increased fluid velocity through the fluid orifice 307 can cause internal erosion of the drill bit. Internal erosion in a drill bit can typically be related to four parameters: mud weight, mud abrasiveness, flow velocity, and geometrical discontinuities. Over time, the drilling industry has found the need to increase the flow rates through the drill bits which has made internal erosion of the fluid orifices a significant source of concern. A ledge 314 formed between the bottom of the fluid plenum 305 and the fluid orifice 307 is particularly troublesome in drill bits. High flow rates cause the fluid flow to separate at the ledge 314 creating recirculation zones that can have sufficient energy to erode the surrounding metal surface. A "washout" occurs when the erosion progresses such that a hole is formed in the bit body 215 that allows the fluid to bypass the nozzle. The washout results in a loss of pressure in the system and requires pulling the drill bit out of the hole to be replaced. This costs the driller a great deal of time and money.

FIG. 4 illustrates one prior art solution disclosed in U.S. Pat. No. 5,538,093 (the '093 patent). In the '093 patent, a sleeve 409 is welded inside of the fluid orifice 307. The sleeve 409 comprises a smoothly contoured fluid entrance 403 which gradually reduces the flow area in preparation for entrance into a nozzle, not shown, at a nozzle seat 406. The fluid entrance 403 helps to eliminate the separation of the fluid and, therefore, reduce the amount of internal erosion. One drawback of this approach is that the sleeve 409 requires a significant amount of space to be effective. As a result, this approach is only available for the large drill bit sizes (i.e., those bits having diameters greater than 11").

Small drill bits (i.e., those bits having diameters smaller than 11") are typically unable to accommodate sleeves in the fluid orifices because there is not sufficient room in the interior of the bit to accommodate the required large fluid orifice without cutting into the side of the bit or into areas reserved for the bit lubrications system, not shown. FIGS. 5 and 6 illustrate a typical small drill bit. To fit a nozzle, not shown, a fluid orifice 505 is usually drilled into the bit body 508 through a bottom of the fluid plenum 504. A nozzle receptacle 509 is then formed inside the fluid orifice 505 for the attachment of the nozzle. The drilling of the fluid orifice 505 leaves a ledge 506 formed between the bottom of the fluid plenum 504 and the fluid orifice 505. Depending on the flow rate and the geometry of the particular drill bit, the ledge 506 can cause fluid separation to occur with sufficient energy to erode the bit body 508 which can lead to a washout. Manufacturing options to remove the ledge 506 are limited due to the limited space and accessibility to the ledge 506 by machining tools.

A prior art solution for small drill bits is shown in FIG. 9. A drill is inserted through the fluid orifice 505 to machine a relief region 901 substantially towards the bit body axis, not shown. While such a relief region provides some improvements in the flow, such a region fails to fully solve the erosion problems present at higher flow rates.

What is still needed, therefore, are drill bits and methods for designing and manufacturing drill bits having improved internal flow characteristics.

SUMMARY OF INVENTION

In one aspect, the present invention relates to a drill bit with improved flow characteristics. The drill bit includes at least one roller cone rotatably mounted to a bit body. The bit body has a fluid plenum with at least one fluid orifice formed in a bottom of the fluid plenum. Flow is improved through at least one fluid orifices by forming a relief region on a ledge formed between a bottom of the fluid plenum and the at least one fluid orifice at an angle greater than 20 degrees and less than 360 degrees as determined by rotating clockwise about a fluid orifice axis from a datum plane.

In one aspect, the present invention relates to a drill bit with improved flow characteristics. The drill bit includes at least one roller cone rotatably mounted to a bit body. The bit body has a fluid plenum with at least one fluid orifice formed in a bottom of the fluid plenum. Flow is improved through the at least one fluid orifice by forming a plurality of relief regions on a ledge formed between a bottom of the fluid plenum and the at least one fluid orifice.

In one aspect, the present invention relates to a drill bit with improved flow characteristics. The drill bit includes at least one roller cone rotatably mounted to a bit body. The bit body has a fluid plenum with at least one fluid orifice formed in a bottom of the fluid plenum. Flow is improved through the at least one fluid orifice by forming a swept relief region on a ledge formed between a bottom of the fluid plenum and the at least one of the fluid orifices.

In one aspect, the present invention relates to a method to improve flow characteristics through a bit body. The bit body includes an inlet and a fluid plenum with at least one fluid orifice formed in a bottom of the fluid plenum. Flow characteristics are improved by determining flow change angles from the bottom of the fluid plenum into the fluid orifices and modeling relief region placement on a ledge formed between the bottom of the fluid plenum and the at least one fluid orifice.

In one aspect, the present invention relates to a method of manufacturing a bit body with improved flow characteristics. The bit body includes an inlet and a fluid plenum with at least one fluid orifice formed in a bottom of the fluid plenum. The flow characteristics through the bit body are improved by forming a relief region on a ledge formed between the bottom of the fluid plenum and the at least one fluid orifice at an angle greater than 20 degrees and less than 360 degrees as determined by rotating clockwise about a fluid orifice axis from a datum plane.

In one aspect, the present invention relates to a method of manufacturing a bit body with improved flow characteristics. The bit body includes an inlet and a fluid plenum with at least one fluid orifice formed in a bottom of the fluid plenum. The flow characteristics through the bit body are improved by forming a plurality of relief regions on a ledge formed between the bottom of the fluid plenum and the at least one fluid orifice.

In one aspect, the present invention relates to a method of manufacturing a bit body with improved flow characteristics. The bit body includes an inlet and a fluid plenum with at least one fluid orifice formed in a bottom of the fluid plenum. The flow characteristics are improved by forming a swept relief region on a ledge formed between the bottom of the fluid plenum and the at least one fluid orifice.

In one aspect, the present invention relates to a method of improving the flow characteristics of a previously manufactured bit body. The bit body includes an inlet and a fluid plenum with fluid orifices formed in a bottom of the fluid plenum. A relief region has been previously formed on a ledge formed between the bottom of the fluid plenum and at least one fluid orifice. The flow characteristics through the bit body are improved by forming at least one additional relief region on the ledge.

Other aspects and advantages of the invention will be apparent from the following description and the appended claims.

DETAILED DESCRIPTION

In one or more embodiments, the present invention relates to forming at least one relief region on a ledge formed between a bottom of the fluid plenum and a fluid orifice inside of a bit body. Further, embodiments of the present invention provide drill bits and methods of forming drill bits having improved internal flow characteristics when compared with prior art drill bits.

Figure 1:
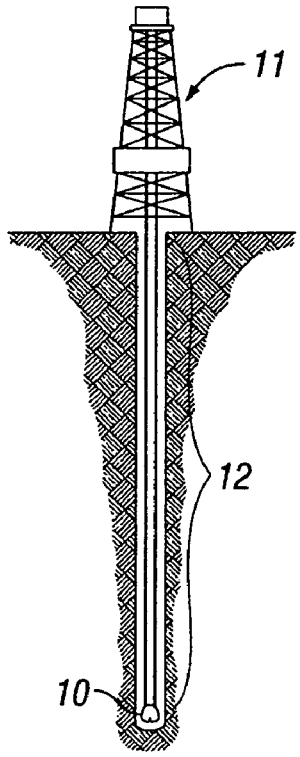
FIG. 1 (Prior Art)
FIG. 1 shows a typical rotary drilling rig, including surface equipment, drill string, and drill bit.
Figure 2:
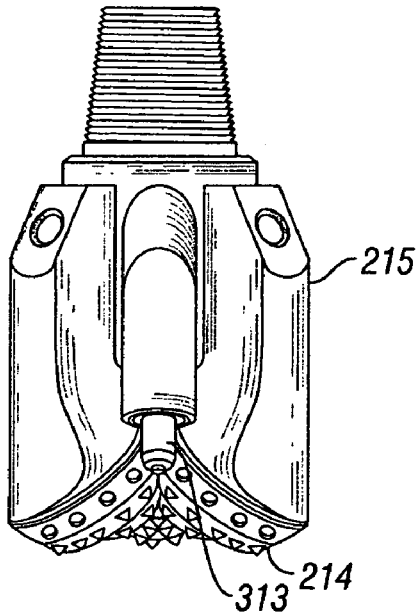
FIG. 2 (Prior Art)
FIG. 2 shows a prior art rotary cone bit.
Figure 3:
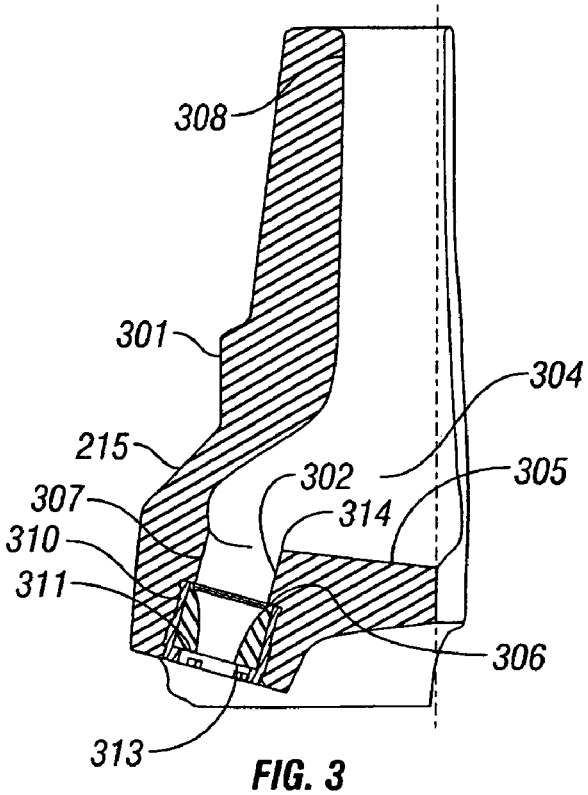
FIG. 3 (Prior Art)
FIG. 3 shows a cross-section of a leg of a prior art rotary cone bit.
Figure 4:
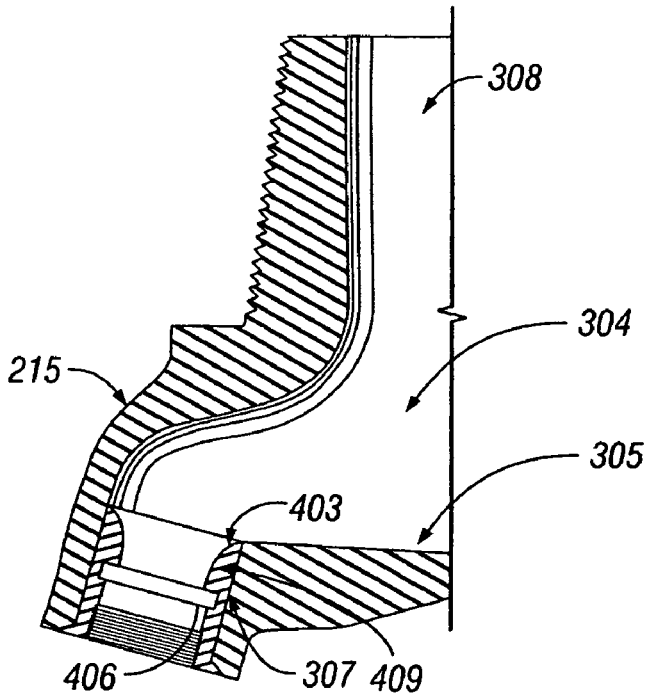
FIG. 4 (Prior Art)
FIG. 4 shows a cross-section of a leg of a prior art rotary cone bit.
Figure 5:
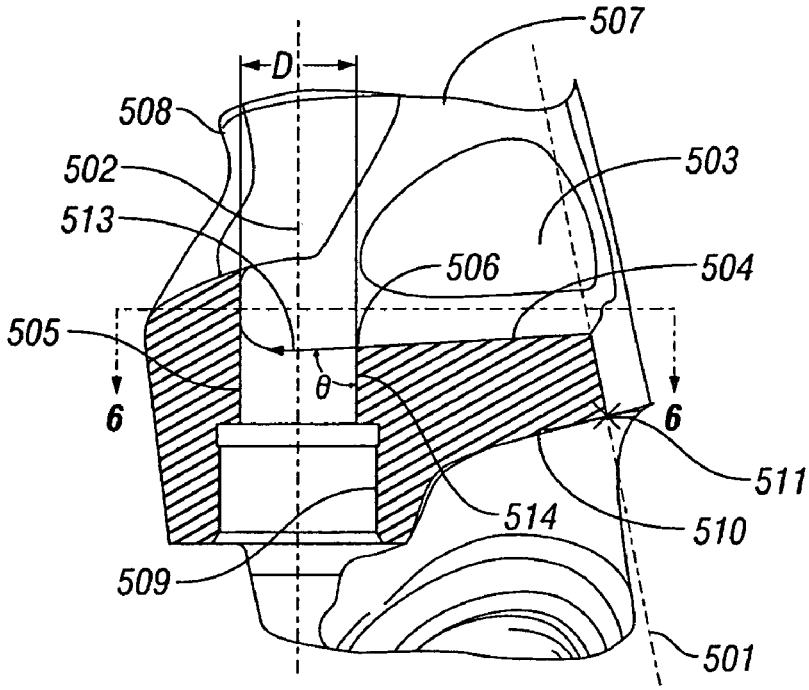
FIG. 5 (Prior Art)
FIG. 5 shows a cross-section of a leg of a prior art rotary cone bit.
Figure 6:
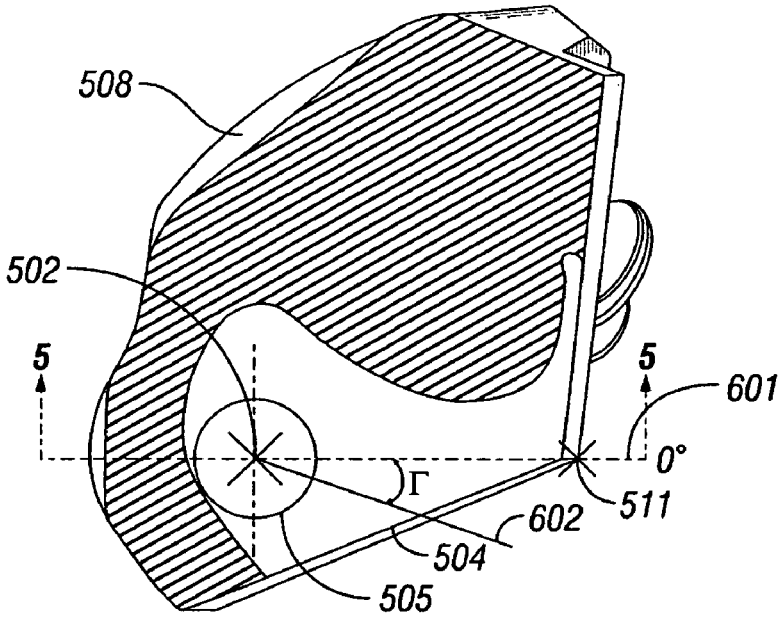
FIG. 6 (Prior Art)
FIG. 6 shows a bottom of a fluid plenum of the leg of the prior art rotary cone bit of FIG. 5.

In order to provide an understanding of aspects of the present invention, prior art FIGS. 5–6 are used to provide an understanding of the terminology and state of the prior art. As discussed in the background, some small prior art drill bits (e.g., those having a diameter less than 11") have experienced significant problems due to internal erosion. FIGS. 5 and 6 show cross-sections of a leg of a prior art bit body 508 after a fluid orifice 505 has been formed in the bit body 508. The fluid orifice 505 has been formed with a drill bore having a diameter "D," and entrance formed by ledge 506, and a nozzle receptacle 509 configured for the receipt of an erosion resistant nozzle, not shown. FIG. 5 is a cross-section at a datum plane 601 (shown in FIG. 6) formed by a fluid orifice axis 502 and a point 511 on a bit body axis 501. The point 511 is located where the bit body axis 501 intersects a dome 510 of the bit body 508.

FIG. 6 is a view towards the distal end of the drill bit and normal to the fluid orifice axis 502. The term "distal end" as used herein refers to the portion of the bit body furthest from an inlet 507. The datum plane 601 is illustrated in FIG. 6 as a line drawn from the bit body axis 501 to the point 511. This line (which is coincident with the datum plane 601) is notated as 0°. For reasons described below, in order to describe embodiments of the present invention, several angles are defined. The angles (Γ, α, and β), which are discussed below, are oriented relative to the datum plane 601. Reference to any angles (Γ, α, and β) in this description is positive for clockwise rotation about the fluid orifice axis 502 based on the view towards the distal end of the bit body.

As discussed above, during drilling, fluid, not shown, enters the bit body 508 at the inlet 507 and continues into the fluid plenum 503. The fluid is forced against the bottom of the fluid plenum 504 until it reaches the ledge 506 formed between the bottom of the fluid plenum 504 and the fluid orifice 505. The fluid follows an angle θ ("flow change angle") at the ledge 506 to enter into the fluid orifice 505 and exit the bit body 508. A nozzle, not shown, would typically be fixed in a nozzle receptacle 509.

The flow change angle θ can be determined by examining two-dimensional ("2-D") cross-sections that are oriented relative to the datum plane 601 illustrated in FIG. 6. A 2-D cross-section 602 is a plane rotated about the fluid orifice axis 502 at an angle Γ relative to the datum plane 601. In FIG. 5, the angle Γ is 0 degrees. In the 2-D cross-section, the flow change angle θ is the angle between a curve 513 and a curve 514. The curve 513 is defined by extending a curve toward the fluid orifice axis 502 tangent to the bottom of the fluid plenum 504 at the ledge 506. Curve 514 is the curve created by the cross-section 602 of the fluid orifice 505. Because the fluid orifice 505 is generally a drilled hole, curve 514 is usually a straight line. The flow change angle θ has particular importance in determining the amount of fluid separation and, therefore, the risk of internal erosion of the bit body 508 due to high flow rates. A higher flow change angle θ results in increased fluid separation.

Figure 7:
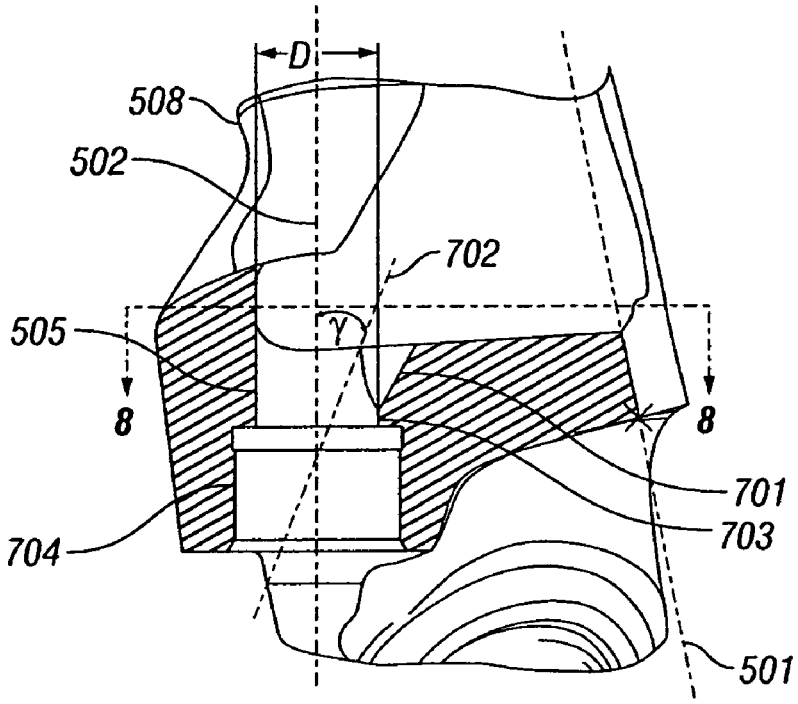
FIG. 7 shows a cross-section of a leg of a rotary cone bit in accordance with one embodiment of the invention.
Figure 8:
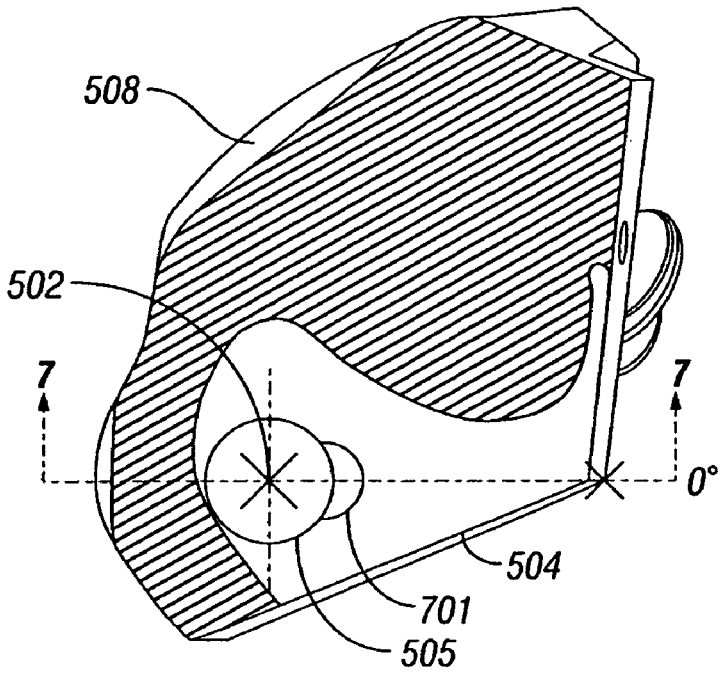
FIG. 8 shows a bottom of a fluid plenum of the leg of the rotary cone bit of FIG. 7.

FIGS. 7 and 8 show cross-sections of an embodiment of the invention. A relief region 701 has been formed on the ledge 506 coincident with the datum plane 601 (angle α=0 degrees). Relief region 701 intersects the cylindrical bore 703 of the fluid orifice 505 above the entrance into a nozzle, not shown, that is installed in the nozzle receptacle 704. The angles Γ, α, and β each refer to a rotation about the fluid orifice axis 502 relative to the datum plane 601. The angles α and β refer to the locations of relief regions. Those having ordinary skill in the art will appreciate that other methods for defining the location of relief regions may be devised without departing from the scope of the present invention. For example, one could locate relief regions based on a reference plane defined by the bit body axis and a point on the fluid orifice axis.

A relief region 701 is formed at an angle γ on the ledge 506. The angle γ is defined herein as the angle of the relief region axis 702 with respect to the fluid orifice axis 502. The magnitude of angle γ may be limited by interference between the bit body 508 and the rotary machining tool. In the prior art, the relief region 601 is formed by a drill, not shown, which is inserted through the fluid orifice 505. The relief region 701 reduces the magnitude of the flow change angle θ. Those having ordinary skill in the art will appreciate that the relief region could be located without referencing the fluid orifice axis without departing from the scope of the invention.

Figure 9:
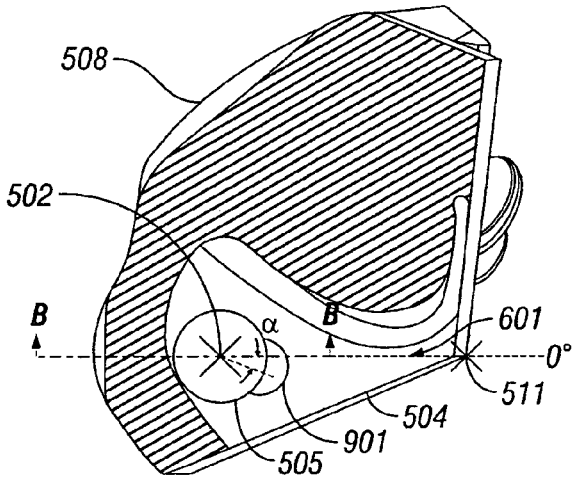
FIG. 9 (Prior Art)
FIG. 9 shows a bottom of a fluid plenum of a leg of a prior art rotary cone bit.

Turning to FIG. 9, a bottom of the fluid plenum 504 of a leg of a prior art rotary cone bit is shown. In the prior art, the relief region 901 has been formed in the range of α=7 degrees to 15 degrees. FIG. 9 illustrates the relief region 901 which has been formed by inserting a drill, not shown, through the fluid orifice 505. The relief region has been formed at the angle α equal to 15 degrees with respect to the datum plane 601.

Figure 10:
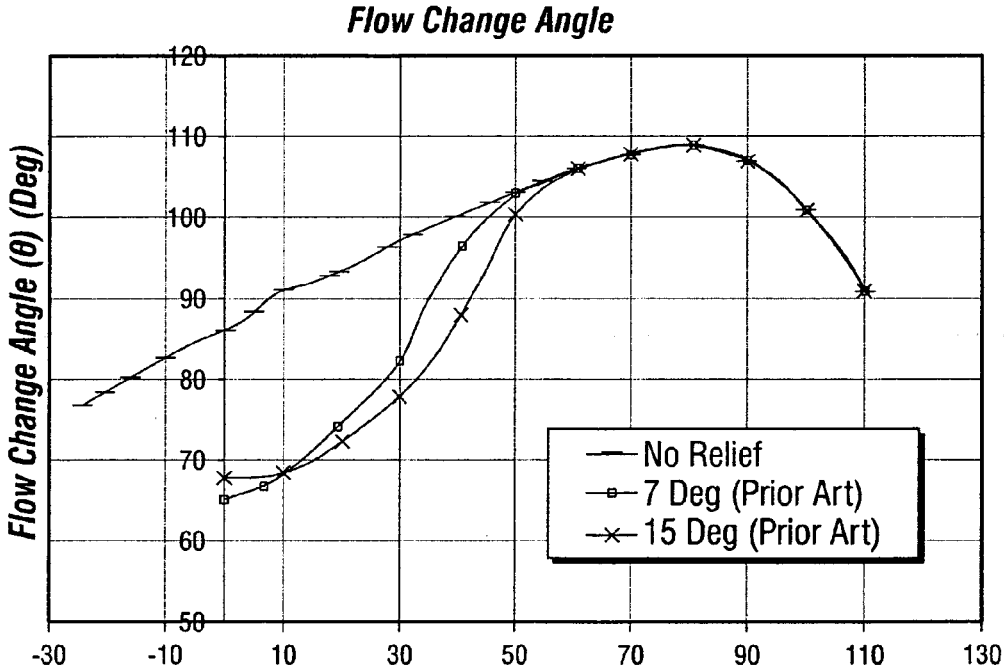
FIG. 10 (Prior Art)
FIG. 10 shows a graph of flow change angles versus cross-section angles for a prior art rotary cone bit.

FIG. 10 illustrates the change of flow change angle θ that results from the prior art relief region. The relief region of the prior art in the range of an angle α of about 7 degrees to 15 degrees decreases the flow change angle θ for a range of 2-D cross-section angles. The graph illustrates that the prior art relief region fails to reduce the flow change angle θ where it is at the highest value. Changing the location of the relief region or forming additional relief regions could advantageously reduce the flow change angle θ where it is highest.

Figure 11:
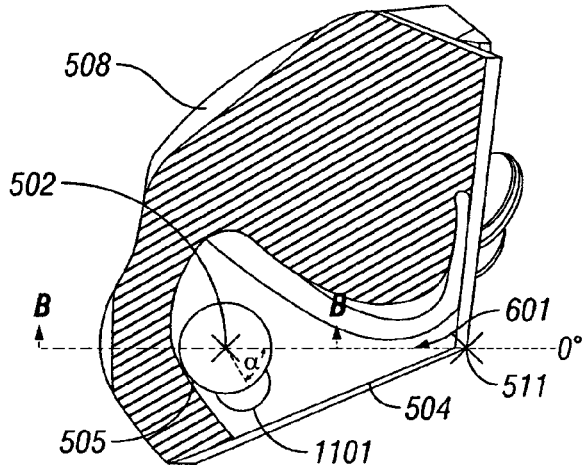
FIG. 11 shows a bottom of a fluid plenum of a leg of a rotary cone bit in accordance with one embodiment of the invention.

Turning to FIG. 11, a cross-section of an embodiment of the invention is shown. In FIG. 11, an embodiment is characterized by a single relief region 1101 being formed on the ledge 506 and located at an angle α relative to the datum plane 601. The angle α has a value of about 65 degrees in this embodiment. In other embodiments, an angle α between 20 degrees and 150 degrees may be preferred. Those having ordinary skill in the art will appreciate that the relief region 1101 may be located at other angles without departing from the scope of this invention.

Figure 12:
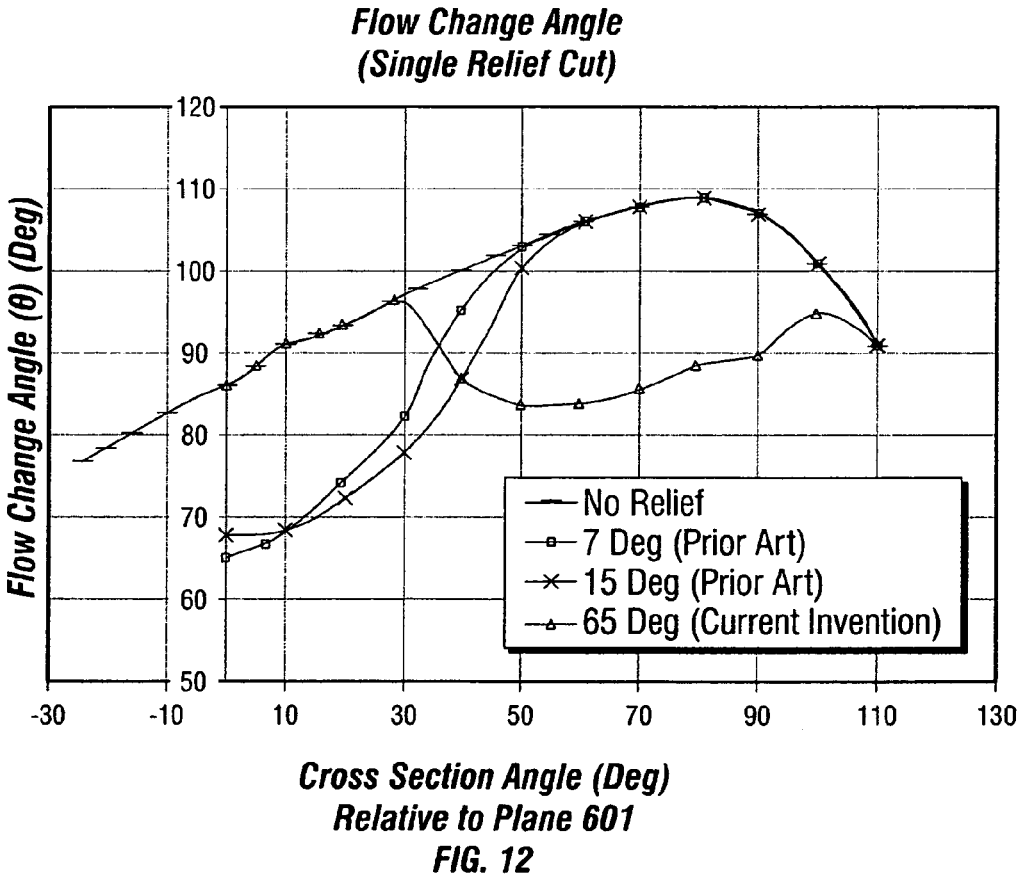
FIG. 12 shows a graph of flow change angles versus cross-section angles in accordance with one embodiment of the invention.

FIG. 12 illustrates the reduction in the flow change angle θ in a range of 2-D cross-section angles after the relief region 1101 has been located as shown in FIG. 11. The highest flow change angle θ is lower than the prior art when the relief region is located at an angle α of 65 degrees. The decrease in flow change angle θ will vary depending on the specific geometry of the bit body and the orientation of the fluid orifice. FIG. 12 only illustrates the reduction in the flow change angle θ for one embodiment of the invention. This chart illustrates that an angle α equal to 30 degrees to 50 degrees may be preferred in another embodiment. In other embodiments, an angle α of 45 degrees to 70 degrees may be preferred. An angle α equal to 65 degrees to 110 degrees may be preferred in another embodiment. The preferable ranges for the angle α will vary with other embodiments. Those having ordinary skill in the art will appreciate that the relief region 1101 may be located at other angles not covered by the prior art without departing from the scope of the invention.

Figure 13:
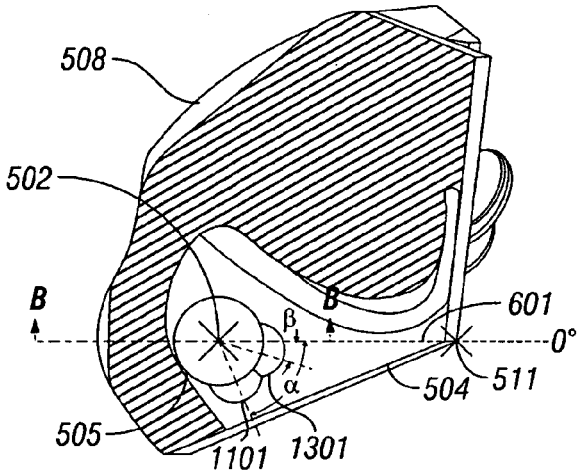
FIG. 13 shows a bottom of a fluid plenum of a leg of a rotary cone bit in accordance with one embodiment of the invention.

In FIG. 13, a cross-section of an embodiment of the present invention is shown. This embodiment of the invention is characterized by two relief regions, 1101 and 1301, formed on the ledge 506 at angles α and β, respectively. The angles α and β are selected based on the geometry of the bit body 508. In a particular embodiment, α is set at 65 degrees and β is set at 15 degrees. In another embodiment, α is set at 85 degrees and β is set at 30 degrees. In another embodiment, α is set at 350 degrees and β is set at 65 degrees. In some embodiments, a first relief region with an angle α between 330 degrees and 30 degrees and a second relief region with an angle β between 30 degrees and 150 degrees may be preferable. Those having ordinary skill in the art will appreciate that the two relief regions, 1101 and 1301, may be located at other angles without departing from the scope of the invention. Additionally, more than two relief regions could be formed without departing from the scope of the invention.

Figure 14:
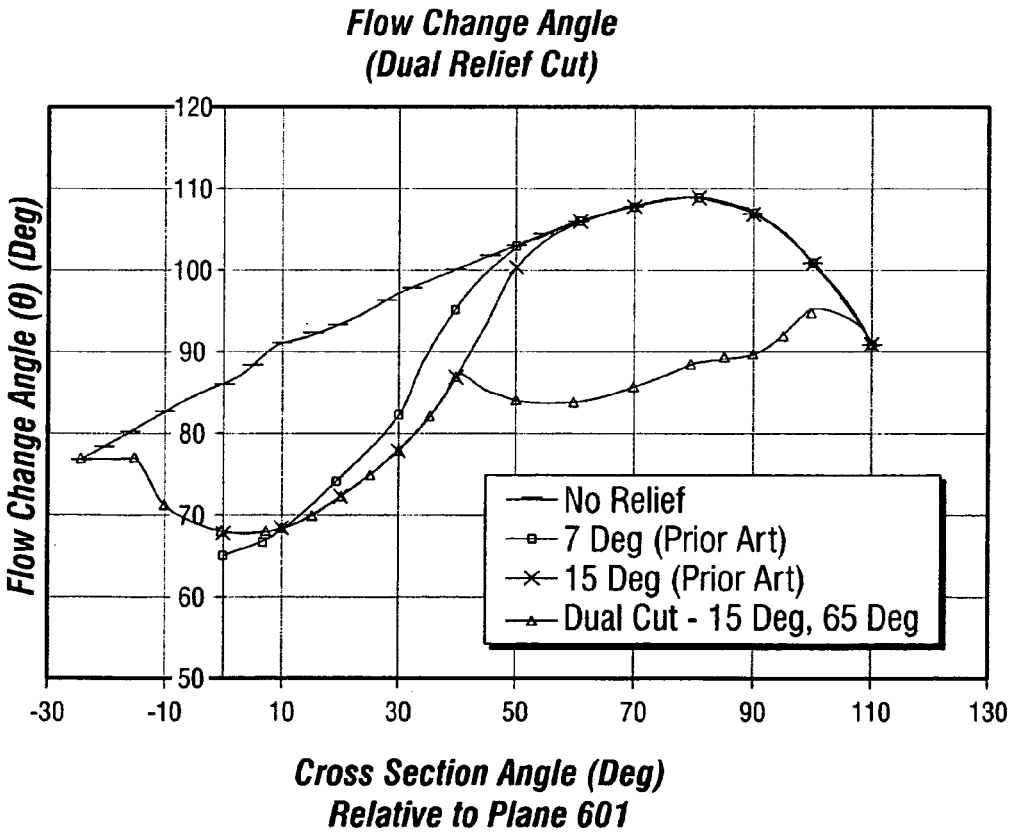
FIG. 14 shows a graph of flow change angles versus cross-section angles in accordance with one embodiment of the invention.

FIG. 14 illustrates the reduction in the flow change angle θ in a range of 2-D cross-section angles after the two relief regions, 1101 and 1301, have been located as shown in FIG. 13. Relief region 1101 has been located at an angle α of 65 degrees. Relief region 1301 has been located at an angle β of 15 degrees The highest flow change angle θ has been further reduced because of the second relief region. FIG. 14 only illustrates the reduction in the flow change angle θ for one embodiment of the invention. The optimal placement for the two relief regions, 1101 and 1301, will vary according to the geometry of the particular embodiment. Additional relief regions could be formed to further reduce the flow change angle θ depending on the particular embodiment.

Figure 15:
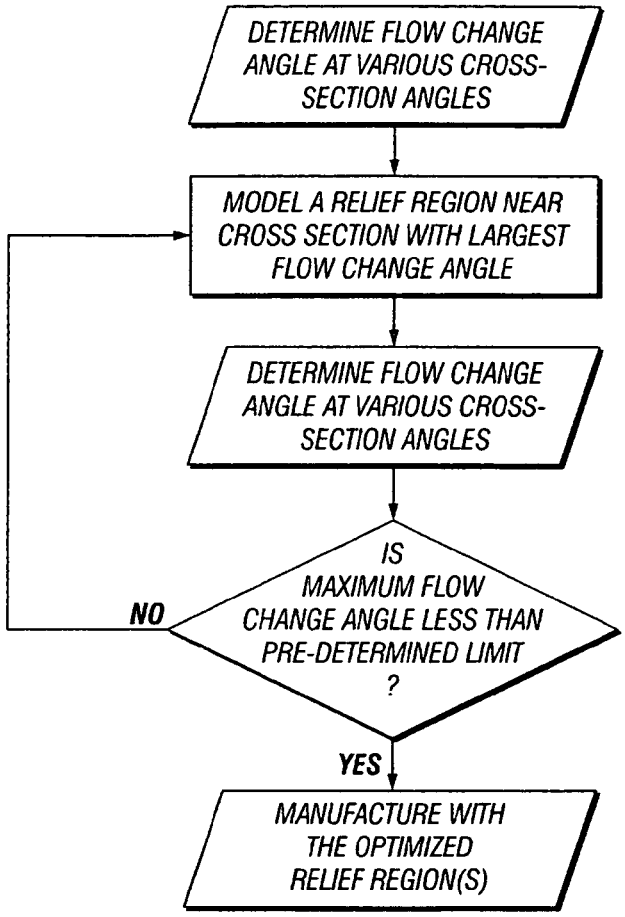
FIG. 15 shows a flowchart of a design method in accordance with one embodiment of the invention.

FIG. 15 is an embodiment of a method to locate at least one relief region to provide improved flow characteristics, as compared to prior art bits. One embodiment of this method determines a flow change angle θ across a range of 2-D cross-sections of a bit body rotated about a fluid orifice. The flow change angles are compared for the purpose of determining an optimal location to form a first relief region. In one embodiment, the flow change angles are determined by using a three-dimensional computer aided drafting ("CAD") model of the bit body. The first relief region is located at an angle α relative to the datum plane. The angle α is selected to be near the location of a maximum flow change angle θ. The relief region (e.g., 1101 in FIG. 11) is then modeled in the CAD model and the flow change angle θ is determined at a range of cross-section angles relative to the datum plane 601 shown in FIG. 6. A second relief region, if the flow change angles have not been sufficiently reduced, is located at an angle β relative to the datum plane, which is determined by the location of the maximum flow change angle θ after the first relief region has been modeled. Those having ordinary skill in the art will appreciate that a single relief region or more than two relief regions may be located by this method without departing from the scope of the invention.

The method for locating relief regions provides an efficient manner to improve flow through the bit body. Examining the flow change angle θ allows improvement of flow through a bit body with minimal analysis and manufacturing iterations. Those having ordinary skill in the art will be able to use this method to locate additional relief regions without departing from the scope of the invention. Additionally, those having ordinary skill in the art will be able to devise other methods for modeling relief regions in a bit body without departing from the scope of the invention.

After modeling the relief regions, computational fluid dynamics ("CFD") analysis (or other fluid modeling techniques) can be performed on the bit body to verify the fluid flow characteristics. The CFD model demonstrates that fluid separation is reduced where the fluid enters the fluid orifice 505 from the bottom of the fluid plenum 504. The required iterations of CFD analysis to improve fluid flow, which can be very time consuming, are advantageously reduced by applying the method of the invention to model relief regions based on the flow change angle θ.

In another embodiment, a prior art bit body has been previously manufactured with a single relief region between an angle α of 7 degrees and 15 degrees. The fluid flow through the bit body is improved by forming a second relief region at an angle β greater than 15 degrees relative to the plane. The result is similar to FIG. 13. In one embodiment, the second relief region is formed using the drill inserted through the fluid orifice from the bottom of the bit body. In another embodiment, the second relief region is formed using the drill inserted through the fluid plenum. Those having ordinary skill in the art will be able to utilize other rotary machining tools capable of making relief regions of various form without departing from the scope of the invention.

Figure 16:
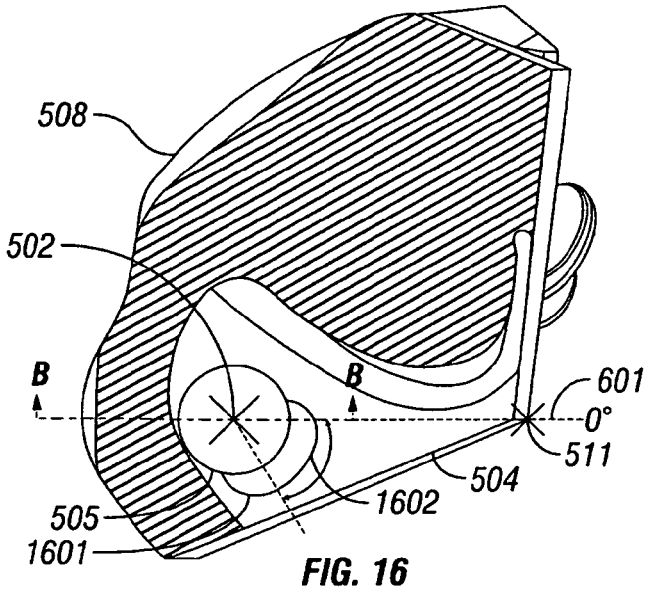
FIG. 16 shows a bottom of a fluid plenum of a leg of a rotary cone bit in accordance with one embodiment of the invention.

FIG. 16 illustrates another embodiment of the invention. A swept relief region 1601 is formed by continuously sweeping a mill, not shown, across the ledge 506. The swept relief region 1601 is characterized by having an outer arcuate section 1602 that is substantially concentric to the fluid orifice axis 502. The mill can be inserted through the fluid plenum 503 or the fluid orifice 505 to form the swept relief region 1601. In this particular embodiment, the swept relief region has been located substantially towards the bit body axis 511 to aid fluid flow from the fluid plenum 503 into the fluid orifice 505. The fluid plenum geometry of a particular embodiment may alter the preferred location for the swept relief region. One of ordinary skill in the art would appreciate that the swept relief region 1601 could be formed by other rotary machining tools or any other means known in the art without departing from the scope of the invention. Additionally, the arcuate section could be non-concentric with the fluid orifice without departing from the scope of the invention.

Figure 17:
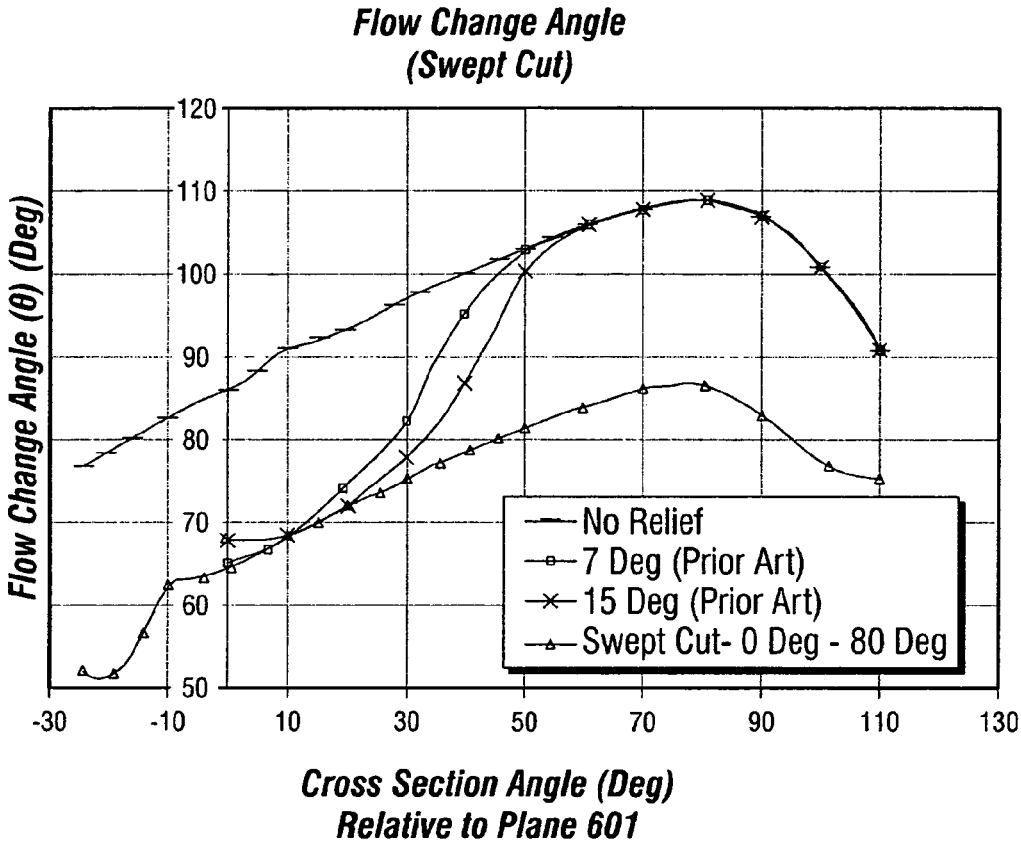
FIG. 17 shows a graph of flow change angles versus cross-section angles in accordance with one embodiment of the invention.

FIG. 17 illustrates the reduction in the flow change angle θ in a range of 2-D cross-section angles after the swept relief region 1601 has been located as shown in FIG. 16. The swept relief region 1601 has been formed with the outer arcuate section 1602 having a span of about 80 degrees. FIG. 17 only illustrates the reduction in the flow change angle θ for one embodiment of the invention. The optimal placement for the swept relief regions 1601 will vary according to the geometry of the particular embodiment. For example, the geometry of the bit may restrict the span of the outer arcuate section 1602 of the swept relief region 1601. For example, the swept relief region 1601 may be restricted to having an outer arcuate section 1602 with a span of only 60 degrees. One of ordinary skill in the art would appreciate that the actual span of the arcuate section 1602 and the orientation of the swept relief region 1601 may vary without departing from the scope of the invention.

The effect of forming relief regions has been examined through the use of CFD. FIGS. 18–21 are images from CFD analysis run on a 9⅞" roller-cone drill bit. The flow rate through the bit is the same for each of the FIGS. 18–21. As mentioned previously, fluid enters the bit body at the inlet and continues into the fluid plenum. The fluid is forced against the bottom of the fluid plenum 504 until it reaches the ledge 506 formed between the bottom of the fluid plenum 504 and the fluid orifice 505. The images in FIGS. 18–21 are of the 2-D cross-section 602 at an angle Γ of 80 degrees. Each of the images are focused on a fluid orifice 505 so that they display the critical fluid flow past the ledge 506 and into the fluid orifice 505. Arrows in the images represent fluid flow. The size of the arrowheads and the length of the tails is proportional to the velocity of the fluid. The arrowheads point in the direction of the fluid flow. The lack of an arrowhead on a line in the images indicates that the particular portion of fluid flow lacks uniform direction. This typically occurs when fluid separates and recirculates in a swirling fashion.

Figure 18:
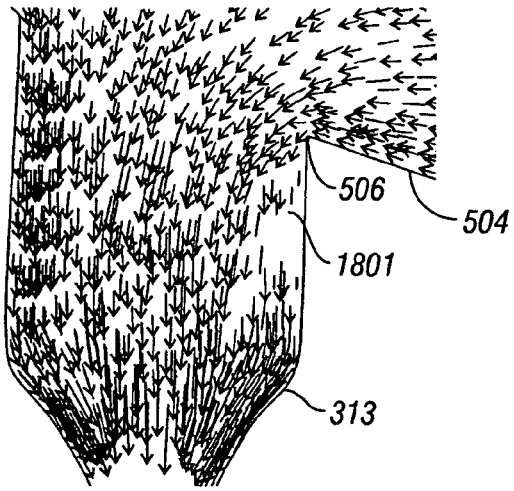
FIG. 18 (Prior Art)
FIG. 18 is an image from a computational fluid dynamics analysis performed on a prior art bit body.

FIG. 18 is the CFD analysis of the 9⅞" bit with a single relief region formed at an angle α of 15 degrees, as in the prior art. A portion of the fluid flows along the bottom of the fluid plenum 504. As the fluid reaches the ledge 506, it turns sharply to enter into the fluid orifice 505. As the fluid turns, it separates and forms a recirculation zone 1801. The fluid swirls in the recirculation zone until it exits the bit body 508 through the nozzle 313. Recirculation is largely responsible for erosion inside of the drill bit. The rate of erosion will vary depending largely on the flow rate, abrasives contained in the fluid, and the amount of recirculation.

Figure 19:
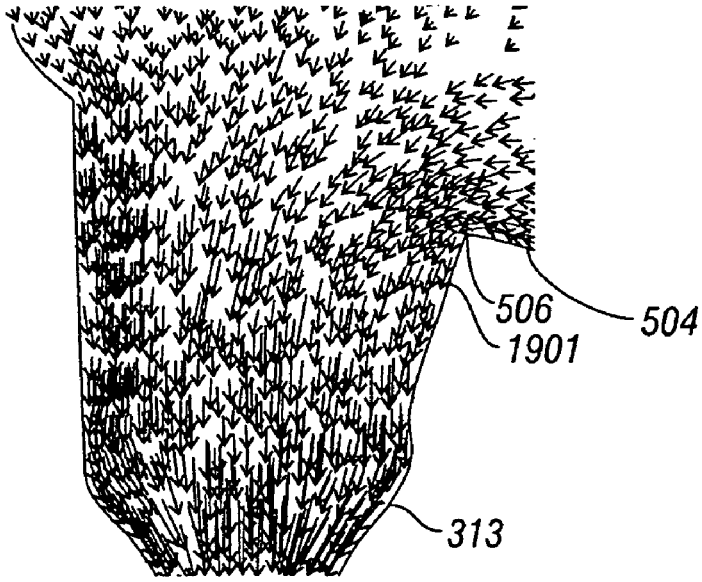
FIG. 19 is an image from a computational fluid dynamics analysis performed on a bit body in accordance with one embodiment of the invention.

FIG. 19 is the CFD analysis of the same 9⅞" bit used in FIG. 18. A single relief region has been formed at an angle α of 65 degrees in accordance with an embodiment of the present invention. The location of the relief region at 65 degrees reduced the flow change angle θ at the angle Γ of 80 degrees as shown in FIG. 18. A recirculation zone 1901 still exists, but is much smaller than the recirculation zone 1801 of FIG. 18. The recirculation zone 1901 is sufficiently small as to typically not cause enough erosion to be of concern.

Figure 20:
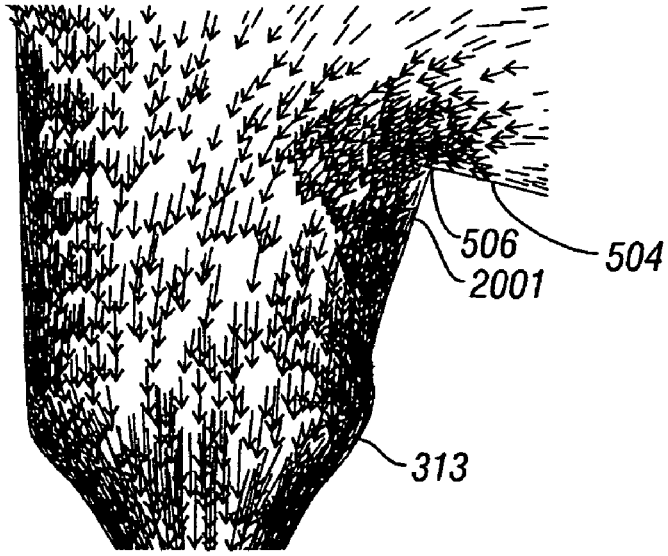
FIG. 20 is an image from a computational fluid dynamics analysis performed on a bit body in accordance with one embodiment of the invention.

FIG. 20 is the CFD analysis of the same 9⅞" bit used in FIG. 18. Two relief regions have been formed at an angle α of 65 degrees and an angle β of 15 degrees in accordance with an embodiment of the present invention. The result is similar to that shown in FIG. 19, but a recirculation zone 2001 is further reduced compared to the recirculation zone 1901.

Figure 21:
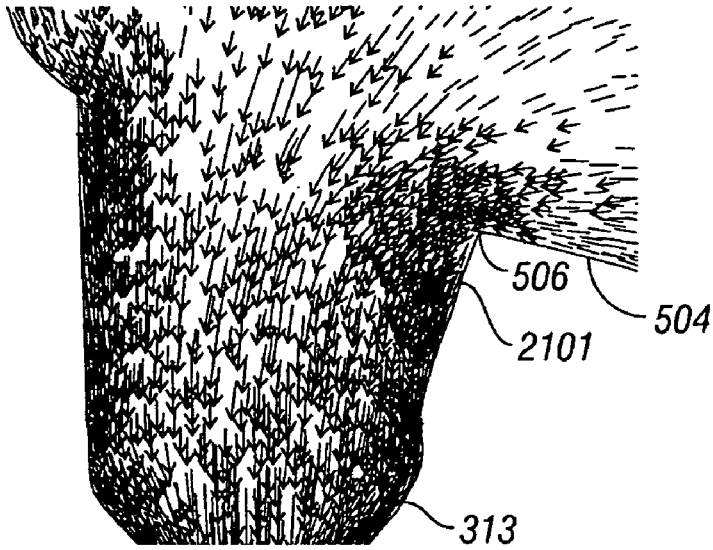
FIG. 21 is an image from a computational fluid dynamics analysis performed on a bit body in accordance with one embodiment of the invention.

FIG. 21 is the CFD analysis of the same 9⅞" bit used in FIG. 18. A swept relief region has been formed with an arcuate section having a span of about 80 degrees in accordance with an embodiment of the present invention. The swept relief region in this example was formed such that the arcuate section begins from the datum plane. The swept relief region results in a recirculation zone 2101 which is further reduced in size compared to recirculation zones 1901 and 2001.

Based on the CFD analysis performed on the 9⅞" bit and actual use of the 9⅞" bit, it has been found that reducing the flow change angle θ below about 95 degrees is typically sufficient. For lower flow rates, a higher flow change angle θ may be acceptable. Higher flow rates may require the flow change angle θ to be further reduced. One of ordinary skill in the art would appreciate that the desired value of the flow change angle θ may be higher or lower without departing from the scope of the invention.

Another aspect of the present invention is the reduction of the fluid velocity at the fluid orifice entrance as the fluid enters into the fluid orifice from the fluid plenum. The forming of at least one relief region on the ledge formed between the bottom of the fluid plenum and the fluid orifice results in an increase in the fluid orifice entrance area. This results in a lower fluid velocity for a given flow rate. The lower fluid velocity results in reduced rate of erosion. This effect is due to lowering the velocity of abrasive particles typically contained in the fluid. As is known in the art, a reduction of velocity results in a reduction of the energy in each abrasive particles. The abrasive particles remove less material from the bit body as a result of their reduced energy.

The overall reduction in the average fluid velocity at the fluid orifice entrance is proportional to the increase in the fluid orifice entrance area. The actual reduction in the fluid velocity will vary across the flow area. CFD or other suitable means could be used to help determine the actual reduction of the fluid velocity at different points across the fluid orifice entrance.

The average reduction of the fluid velocity can be estimated by determining the increase in the fluid orifice entrance area resulting from the forming of relief regions. A comparison of the prior art FIG. 6 with some embodiments of the present invention illustrated in FIGS. 11, 13, and 16 aids in determining the increase in the fluid orifice entrance area. FIGS. 6, 11, 13, and 16 are oriented normal to the fluid orifice 502. FIG. 6 does not contain a relief region. FIGS. 11, 13, and 16 contain one relief region, two relief regions, and one swept relief region respectively. Comparing each of these embodiments illustrates the increase in the fluid orifice entrance area. The fluid orifice entrance area may be determined using a CAD model of the bit body 508, scanning equipment on an actual bit body, or any other suitable means known in the art.

Figure 22:
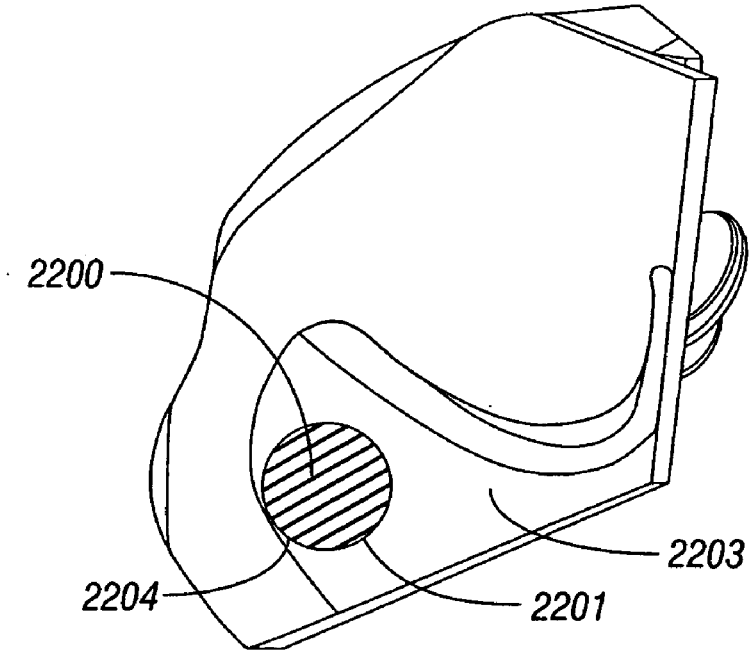
FIG. 22 shows a bottom of a fluid plenum of a leg of a prior art rotary cone bit.
Figure 23:
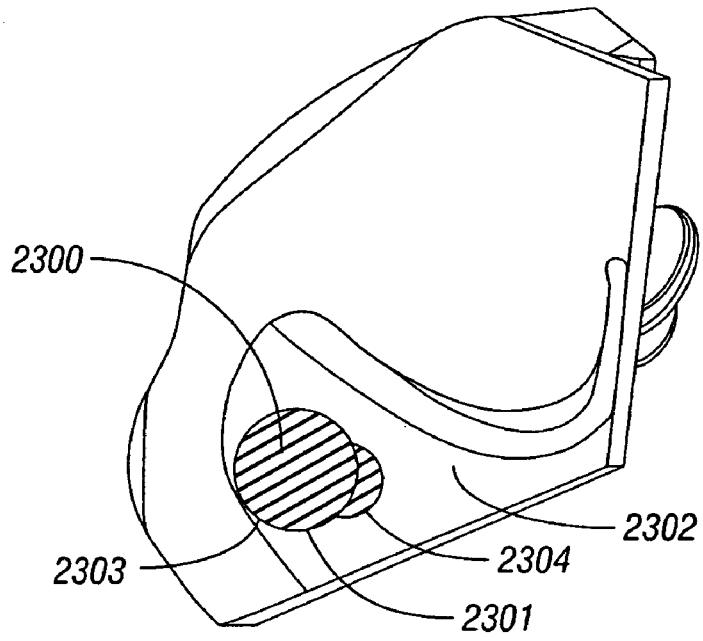
FIG. 23 shows a bottom of a fluid plenum of a leg of a rotary cone bit in accordance with one embodiment of the invention.

FIGS. 22 and 23 illustrate one means of determining the fluid orifice entrance area using a CAD model of the bit body. FIG. 22 shows a nozzle orifice entrance with no relief region. The view is oriented normal to the nozzle orifice bore axis. The projected entrance area is shown by the cross hatching 2200. The bounds of the entrance area are defined by ledge 2201 created at the intersection of the fluid plenum 2203 and the fluid orifice 2204. FIG. 23 shows fluid orifice 2303 with a relief region 2304 in a view that is oriented normal to the nozzle orifice axis 2401 and shows the fluid orifice entrance area 2300 in cross-hatching. The entrance area is bounded by ledge 2301 that is created by the intersection of fluid orifice 2303 and fluid plenum 2302.

Figure 24:
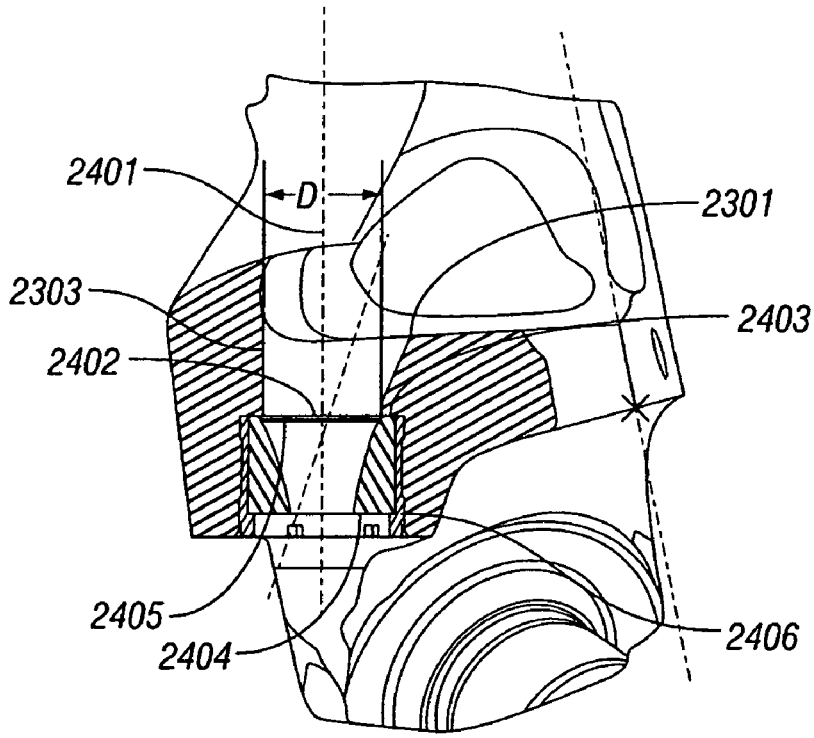
FIG. 24 shows a cross-section of a leg of a rotary cone bit in accordance with one embodiment of the present invention.

FIG. 24 illustrates the nozzle entrance area, which can be compared to the fluid orifice entrance area to determine the increase in the fluid orifice entrance area. The nozzle entrance area 2402 is the area of the fluid orifice 2303 adjacent to the nozzle seat 2403. Usually the nozzle entrance area 2402 will have a diameter "D" that is about the same as the entrance diameter 2405 of the nozzle 2404. While the nozzle entrance area is generally circular, it could also have other shapes to condition the flow for entrance into the nozzle. The nozzle is held against the nozzle seat by retainer 2406. While nozzle retainer 2406 is threaded in this embodiment, snap ring retention, nail retention or other means of retaining the nozzle could be used without departing from the scope of the invention.

Prior art fluid orifices with single relief regions had fluid entrance areas that were larger than the nozzle entrance area by about 16 percent or less. However, in many embodiments, it is preferable to have a fluid orifice entrance area that is greater than 20 percent larger than the nozzle entrance area. It may be more preferable to have a fluid orifice entrance area that is about 30 percent or larger than a nozzle orifice entrance area without a relief cut. It may be even more preferable to have entrance area that is about 40 percent or larger than nozzle entrance area. Thus, another embodiment of the current invention is the use of a single relief region as shown in FIG. 9 but with a orifice entrance area that is 20 percent or more larger than the nozzle entrance area.

Once the fluid orifice entrance area and nozzle entrance area have been determined, the two values can be compared. For example, a fluid orifice with a nozzle entrance diameter of about 1.06 inches has an approximate nozzle entrance area of 0.88 $in^2$. Forming one relief region similar to the relief region shown in FIGS. 7 and 8 results in a fluid orifice entrance area of approximately 1.02 $in^2$. This represents about a 16 percent increase in the fluid orifice entrance area. Forming a single relief region at a larger angle γ could result in an increase of the fluid orifice entrance area of 20 percent. Forming two relief regions similar to those shown in FIG. 13 results in a fluid orifice entrance area of approximately 1.14 $in^2$. This represents about a 30 percent increase in the fluid orifice entrance area. Forming a swept relief region similar to that shown in FIG. 16 results in a fluid orifice entrance area of approximately 1.25 $in^2$. This represents about a 42 percent increase in the fluid orifice entrance area when compared to original cross-sectional area of the fluid orifice. The actual decrease in the fluid velocity at the fluid orifice entrance will be nearly proportional to the increase in the fluid orifice entrance area. One of ordinary skill in the art will appreciate that forming larger, smaller, or additional relief regions will affect the fluid orifice entrance area without departing from the scope of the present invention.

As discussed in the Background section, the fluid accelerates as it flows into the fluid orifice from the fluid plenum. This rapid acceleration occurs where the fluid flows across the ledge formed between the bottom of the fluid plenum and the fluid orifice. The sudden change in direction of the fluid combined with the increased fluid velocity contributes to the occurrence of fluid separation. Increasing the fluid orifice entrance area causes the fluid velocity to be lower in this important area. A reduced fluid velocity assists in reducing the amount of separation of the fluid as it flows across the ledge formed between the bottom of the fluid plenum and the fluid orifice to enter into the fluid orifice. Additionally, it reduces the velocity of any small recirculation zones the may still exist, which greatly reduces the kinetic energy of the recirculation zone. The reduction in fluid separation will vary in different embodiments. The geometry of the particular bit body, fluid properties, flow rate, and other factors will result in varying reductions in fluid separation.

While the above discussion has demonstrated relief regions that have been formed as drilled or milled straight with a semi-circle or conic profile, the scope of the invention is not limited to these forms of relief regions. The relief regions may be formed with various shapes. A rotary machining tool of a desired shape may be utilized to form a relief region in accordance with the present invention. In one embodiment of the invention, the relief region is formed with a chamfer cutter that forms two steps such that the flow change angle θ is further reduced. In another embodiment of the invention, a swept relief region is formed with an elliptical profile by an elliptically shaped end mill. In another embodiment, a ball end mill of a desired radius is used to form the relief region with a round profile. One of ordinary skill in the art would appreciate that relief regions could be formed in other profiles by rotary machining tools to reduce the flow change angle θ without departing from the scope of the invention. Additionally, one of ordinary skill in the art would appreciate that the relief region could be formed by any other manufacturing method known in the art without departing from the scope of the invention.

Embodiments of the present invention provide one or more of the following advantages. Locating relief regions to reduce the flow change angle θ reduces separation of the fluid as it enters the fluid orifice from the fluid plenum. Separation of the fluid results in recirculation of the fluid, which commonly includes harsh abrasives that erode the bit body. The resulting erosion can eventually lead to a washout of the bit body. A washout requires pulling the drill string out of the wellbore and replacing the drill bit at a great expense of time and money. By reducing fluid separation, the disclosed invention advantageously reduces the occurrence of washouts.

Moreover, reduction in the flow change angle θ advantageously allows for less energy loss by reducing fluid separation. The energy that erodes the bit body to cause the washout is provided by surface equipment. When fluid separates in a flow stream, pressure is lost. The surface equipment must provide the pressure to overcome those losses. Surface equipment is limited in the pressure that it can provide. Reducing these pressure losses advantageously allows for a higher flow rate at a lower pressure. The higher flow rate may provide more effective removal of cuttings.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit, comprising:

a bit body having a connection adapted to connect to a drill string; and at least one roller cone rotatably mounted on the bit body, wherein the bit body comprises:

a fluid plenum in communication with a fluid inlet and at least one fluid orifice, wherein a ledge formed between a bottom of the fluid plenum and the at least one fluid orifice has a relief region formed therein located at an angle greater than about 20 degrees and less than about 360 degrees as determined by rotating clockwise about a fluid orifice axis from a datum plane.

2. The drill bit of claim 1, wherein the drill bit has a diameter of less than about eleven inches.

3. The drill bit of claim 1, wherein the relief region is formed at an angle greater than about 20 degrees and less than about 150 degrees as determined by rotating clockwise about a fluid orifice axis from a datum plane.

4. A drill bit, comprising:

a bit body having a connection adapted to connect to a drill string; and at least one roller cone rotatably mounted on the bit body, wherein the bit body comprises:

a fluid plenum in communication with a fluid inlet and at least one fluid orifice, wherein a ledge formed between a bottom of the fluid plenum and at least one of the fluid orifices has a plurality of relief regions formed therein.

5. The drill bit of claim 4, wherein the drill bit has a diameter of less than about eleven inches.

6. The drill bit of claim 4, wherein the plurality of relief regions comprise:

a first relief region located at an angle between about 330 degrees and about 30 degrees and a second relief region located an angle between about 30 degrees and about 150 degrees as determined by rotating clockwise about a fluid orifice axis from a datum plane.

7. The drill bit of claim 6, further comprising a third relief region located between the first relief region and the second relief region.

8. A drill bit, comprising:

a bit body having a connection adapted to connect to a drill string; and at least one roller cone rotatably mounted on the bit body, wherein the bit body has formed therein:

a fluid plenum in communication with a fluid inlet and at least one fluid orifice, wherein a swept relief region is formed on a ledge formed between a bottom of the fluid plenum and the at least one fluid orifice.

9. The drill bit of claim 8, wherein the drill bit has a diameter of less than about eleven inches.

10. The drill bit of claim 8, wherein the swept relief region has an outer arcuate section having a span of at least 60 degrees and is located substantially towards a bit body axis.

11. The drill bit of claim 8, wherein an outer arcuate section of the swept relief region is non-concentric with the at least one fluid orifice.

12. A method of improving a drill bit body design having formed therein a fluid plenum in communication with a fluid inlet and at least one fluid orifice wherein a ledge is formed between a bottom of the fluid plenum and the at least one fluid orifice, the method comprising:

determining flow change angles from the fluid plenum of the drill bit into the fluid orifice; and modeling a relief region on the ledge to optimize flow into the at least one fluid orifice.

13. The method of claim 12, further comprising determining a maximum flow change angle.

14. The method of claim 13, further comprising modeling the relief region no more than ten degrees from the location of the maximum flow change angle.

15. The method of claim 14, further comprising repeating the determining flow change and the modeling a relief region until the maximum flow change angle is less than a selected angle.

16. The method of claim 15, wherein the selected angle is less than about ninety-five degrees.

17. A method of manufacturing a bit body with improved flow characteristics having formed therein a fluid plenum in communication with a fluid inlet and at least one fluid orifice, wherein a ledge is formed between a bottom of the fluid plenum and the at least one fluid orifice, the method comprising:

forming a relief region located at an angle greater than 20 degrees and less than 360 degrees as determined by rotating clockwise about a fluid orifice axis from a datum plane on the ledge.

18. The method of claim 17, the relief region is formed by a rotary machining tool selected from a mill, a drill, a chamfer cutter, and a ball end mill.

19. The method of claim 18, wherein the rotary machining tool is inserted through the at least one fluid orifice to form the relief region.

20. The method of claim 18, wherein the rotary machining tool is inserted through the fluid plenum to form the relief region.

21. A method of manufacturing a bit body with improved flow characteristics having formed therein a fluid plenum in communication with a fluid inlet and at least one fluid orifice wherein a ledge is formed between a bottom of the fluid plenum and the at least one fluid orifice, the method comprising:

forming a plurality of relief regions on the ledge.

22. The method of claim 21, wherein the plurality of relief regions increases a cross-sectional area of an entrance of the at least one fluid orifice greater than about 30 percent.

23. The method of claim 21, wherein the plurality of relief regions are formed by a rotary machining tool selected from a mill, a drill, a chamfer cutter, and a ball end mill.

24. The method of claim 23, wherein the rotary machining tool is inserted through the at least one fluid orifice to form the plurality of relief regions.

25. The method of claim 23, wherein the rotary machining tool is inserted through the fluid plenum to form the plurality of relief regions.

26. A method of manufacturing a bit body with improved flow characteristics having formed therein a fluid plenum in communication with a fluid inlet and at least one fluid orifice wherein a ledge is formed between a bottom of the fluid plenum and the at least one fluid orifice, the method comprising:

forming a swept relief region on the ledge.

27. The method of claim 26, wherein the swept relief region increases a cross-sectional area of an entrance of the at least one fluid orifice greater than about 30 percent.

28. The method of claim 26, wherein the swept relief region is formed by a rotary machining tool selected from a mill, a drill, a chamfer cutter, and a ball end mill.

29. The method of claim 28, wherein the rotary machining tool is inserted through the at least one fluid orifice to form the swept relief region.

30. The method of claim 28, wherein the rotary machining tool is inserted through the fluid plenum to form the swept relief region.

31. A method of manufacturing a bit body with improved flow characteristics having formed therein a fluid plenum in communication with a fluid inlet and at least one fluid orifice wherein a single relief region has been formed into a ledge formed between a bottom of the fluid plenum and fluid orifice, the method comprising:

forming at least one additional relief region on the ledge.

32. The method of claim 31, wherein the at least one additional relief region is formed by a rotary machining tool selected from a mill, a drill, a chamfer cutter, and a ball end mill.

33. The method of claim 32, wherein the rotary machining tool is inserted through the at least one fluid orifice to form the at least one additional relief region.

34. The method of claim 32, wherein the rotary machining tool is inserted through the fluid plenum to form the at least one additional relief region.

35. A drill bit, comprising:

a bit body having a connection adapted to connect to a drill string, wherein the bit body comprises:

a fluid plenum configured to be in fluid communication with a fluid inlet and at least one fluid orifice;

each of the at least one fluid orifice comprising;

a fluid orifice entrance area, a relief region, a nozzle entrance area, and a nozzle receptacle, wherein the fluid orifice entrance area is at least 20 percent larger than the nozzle entrance area.

36. The drill bit of claim 35, wherein the relief region is located at an angle between about 20 degrees and about 360 degrees as determined by rotating clockwise about a fluid orifice axis from a datum plane.

37. The drill bit of claim 35, wherein the relief region comprises a swept relief region.

38. The drill bit of claim 35, wherein the nozzle entrance area is substantially circular.

39. The drill bit of claim 35, wherein the fluid orifice entrance area is at least 30 percent larger than the nozzle entrance area.

40. The drill bit of claim 39, wherein the relief region is located at an angle between about 20 degrees and about 360 degrees as determined by rotating clockwise about a fluid orifice axis from a datum plane.

41. The drill bit of claim 39, wherein the nozzle entrance area is substantially circular.

42. The drill bit of claim 39, wherein the relief region comprises a swept relief region.

43. The drill bit of claim 35, wherein the fluid orifice entrance area is at least 40 percent larger than the nozzle entrance area.

44. The drill bit of claim 43, wherein the relief region is located at an angle between about 20 degrees and about 360 degrees as determined by rotating clockwise about a fluid orifice axis from a datum plane.

45. The drill bit of claim 43, wherein the nozzle entrance area is substantially circular.

46. The drill bit of claim 43, wherein the relief region comprises a swept relief region.

47. A method of manufacturing a bit body with improved flow characteristics having formed therein a fluid plenum in communication with a fluid inlet and at least one fluid orifice wherein a single relief region has been formed into a ledge formed between a bottom of the fluid plenum and fluid orifice, the method comprising:

forming a relief region on the ledge such that a fluid orifice entrance area is at least 20 percent larger than a nozzle entrance area.

48. The method of claim 47, wherein the relief region is formed by a rotary machining tool selected from a mill, a drill, a chamfer cutter, and a ball end mill.

49. The method of claim 48, wherein the rotary machining tool is inserted through the at least one fluid orifice to form the relief region.

50. The method of claim 48, wherein the rotary machining tool is inserted through the fluid plenum to form the relief region.

51. The method of claim 47, wherein the fluid orifice entrance area is at least 30 percent larger than the nozzle entrance area.

52. The method of claim 51, wherein the relief region is formed by a rotary machining tool selected from a mill, a drill, a chamfer cutter, and a ball end mill.

53. The method of claim 52, wherein the rotary machining tool is inserted through the at least one fluid orifice to form the relief region.

54. The method of claim 52, wherein the rotary machining tool is inserted through the fluid plenum to form the relief region.

55. The method of claim 47, wherein the fluid orifice entrance area is at least 40 percent larger than the nozzle entrance area.

56. The method of claim 55, wherein the relief region is formed by a rotary machining tool selected from a mill, a drill, a chamfer cutter, and a ball end mill.

57. The method of claim 56, wherein the rotary machining tool is inserted through the at least one fluid orifice to form the relief region.

58. The method of claim 56, wherein the rotary machining tool is inserted through the fluid plenum to form the relief region.

* * * * *